US005105838A

United States Patent [19]

White et al.

[11] Patent Number: 5,105,838

[45] Date of Patent: Apr. 21, 1992

[54] CIGARETTE

[75] Inventors: Jackie L. White, Pfafftown; Thomas A. Perfetti, Winston-Salem, both of N.C.

[73] Assignee: R.J. Reynolds Tobacco Company, Winston-Salem, N.C.

[21] Appl. No.: 601,551

[22] Filed: Oct. 23, 1990

[51] Int. Cl.[5] ..... A24D 1/00; A24D 1/02

[52] U.S. Cl. ..... 131/365; 131/360; 131/364; 131/194

[58] Field of Search ..... 131/194, 385, 336, 349, 131/361

[56] References Cited

U.S. PATENT DOCUMENTS

| | | | |
|---|---|---|---|
| 2,592,554 | 4/1952 | Frankenburg . | |
| 2,998,012 | 8/1961 | Lamm . | |
| 3,395,714 | 8/1968 | Kahane | 131/336 |
| 3,516,417 | 6/1970 | Moses . | |
| 3,773,053 | 11/1973 | Stephens, Jr. . | |
| 3,910,287 | 10/1975 | Walton . | |
| 4,219,031 | 8/1980 | Rainer et al. . | |
| 4,505,282 | 3/1985 | Cogbill et al. . | |
| 4,553,556 | 11/1985 | Lephardt . | |
| 4,637,410 | 1/1987 | Luke . | |
| 4,638,819 | 1/1987 | Ikeda . | |
| 4,691,717 | 8/1987 | Ikeda et al. . | |
| 4,756,318 | 7/1988 | Clearman et al. . | |
| 4,770,192 | 9/1988 | De La Cerda . | |
| 4,771,795 | 9/1988 | White et al. . | |
| 4,779,631 | 10/1988 | Durocher et al. . | |
| 4,858,630 | 8/1989 | Banerjee et al. . | |
| 4,878,507 | 11/1989 | Case et al. | 131/365 |
| 4,911,184 | 3/1990 | Case et al. . | |
| 4,913,169 | 4/1990 | Templeton . | |
| 4,913,171 | 4/1990 | Lasko . | |
| 4,917,121 | 4/1990 | Riehl et al. . | |
| 4,955,397 | 9/1990 | Johnson et al. . | |
| 4,961,438 | 10/1990 | Korte . | |
| 4,984,588 | 1/1991 | Stewart, Jr. . | |
| 4,986,287 | 1/1991 | Schneider et al. . | |
| 5,016,656 | 5/1991 | McMurtie . | |

FOREIGN PATENT DOCUMENTS

| | | |
|---|---|---|
| 156628 | 10/1985 | European Pat. Off. . |
| 162704 | 11/1985 | European Pat. Off. . |
| 304766 | 3/1989 | European Pat. Off. . |
| 0380324 | 1/1990 | European Pat. Off. . |
| 2224921 | 5/1990 | United Kingdom . |
| 2225701 | 6/1990 | United Kingdom . |

*Primary Examiner*—V. Millen

*Attorney, Agent, or Firm*—August J. Borschke

[57] ABSTRACT

A cigarette having a circumference of about 25 mm includes a rod of tobacco cut filler having a circumference of about 12.5 mm which is in turn circumscribed by an air permeable insulating material. The tobacco cut filler has a packing density of less than about 400 mg/cm$^3$. The insulating material comprises a fibrous material (e.g., glass fibers), and has a radial thickness of greater than about 0.25 mm, and often greater than about 0.5 mm. The insulating material is in turn circumscribed by a paper wrapping material having a low air permeability (e.g., less than about 15 CORESTA units). The cigarette includes a filter element at one end. The cigarette yields low levels of visible sidestream smoke.

41 Claims, 2 Drawing Sheets

CIGARETTE

BACKGROUND OF THE INVENTION

The present invention relates to cigarettes and other smoking articles, and in particular to cigarettes, which when smoked, yield relatively low levels of incomplete combustion products, generate low amounts of sidestream "tar" and odor, and sustain smolder during FTC smoking conditions.

Popular smoking articles, such as cigarettes, have a substantially cylindrical rod shaped structure and include a roll or charge of smokable material, such as shredded tobacco material (e.g., in cut filler form), wrapped in a paper wrapper, thereby forming a so-called "smokable rod". Normally, a cigarette has a cylindrical filter element aligned in an end-to-end relationship with the smokable rod. Typically, a filter element includes cellulose acetate tow circumscribed by plug wrap, and is attached to the smokable rod using a circumscribing tipping material.

Typically, cigarettes are employed by the smoker by lighting one end thereof and burning the smokable rod. As such, smoke normally is provided by burning smokable material, which typically is tobacco cut filler. The smoker then receives mainstream smoke (e.g., mainstream tobacco smoke) into his/her mouth by drawing on the opposite end (e.g., the filter end) of the cigarette. As such, the smoker is provided with the pleasures of smoking (e.g., smoking taste, feel, satisfaction, and the like).

During the time that the cigarette is burning, sidestream smoke is generated. Sidestream smoke is smoke which directly enters the atmosphere from the lit end of the cigarette. Sidestream smoke diffuses into the atmosphere, and the characteristic visible nature and odor thereof may be perceived negatively by some individuals. The relative amount of visible sidestream smoke generated by a burning cigarette is related to the amount of sidestream "tar" generated by that burning cigarette. Typical commercially available cigarettes which burn tobacco cut filler, and have lengths of about 84 mm (e.g., having a smokable rod length of about 57 mm and a filter element length of about 27 mm), often yield about 25 to about 35 mg of sidestream "tar" per cigarette. See, Proctor et al, Analyst. Vol. 113, p. 1509 (1988), for an apparatus and technique for determining the sidestream "tar" of a cigarette.

Numerous cigarettes which reportedly yield relatively low levels of visible sidestream smoke have been proposed. See, for example, U.S. Pat. Nos. 4,637,410 to Luke; 4,624,268 to Baker et al; 4,407,308 to Baker; 4,231,377 to Cline et al; 4,420,002 to Cline; 4,450,847 to Owens; 4,108,151 to Martin; 4,225,636 to Cline; 4,433,697 to Cline; 4,461,311 to Mathews et al; and 4,561,454 to Guess.

Through the years, there have been proposed various methods for altering the composition of mainstream tobacco smoke. For example, many tobacco substitute materials have been proposed, and a substantial listing of such materials can be found in U.S. Pat. No. 4,079,742 to Rainer et al. In addition, tobacco substitute smoking materials having the tradenames Cytrel and NSM were introduced in Europe during the 1970's.

Numerous references have proposed articles which generate flavored vapor and/or visible aerosol. Most of such articles have employed a combustible fuel source to provide an aerosol and/or to heat an aerosol forming material. See, for example, the background art cited in U.S. Pat. No. 4,714,082 to Banerjee et al.

Smoking articles which are capable of providing the pleasures associated with cigarette smoking, by heating but not necessarily burning tobacco, and without delivering considerable quantities of incomplete combustion products, are described in U.S. Pat. Nos. 4,714,082 to Banerjee et al; 4,756,318 to Clearman et al; and 4,793,365 to Sensabaugh, Jr. et al. Such smoking articles employ a combustible fuel element for heat generation; and aerosol forming substances positioned physically separate from, and in a heat exchange relationship with, the fuel element. During use, heat generated by the fuel element acts to volatilize the aerosol forming substances, thereby providing an aerosol which resembles tobacco smoke. Such smoking articles yield extremely low levels of visible sidestream smoke as well as low levels of FTC "tar".

It would be desirable to provide a good tasting cigarette which provides good smoking satisfaction, provides relatively low levels of incomplete combustion products, sustains smolder during FTC smoking conditions, and generates low levels of sidestream "tar" and hence low levels of visible sidestream smoke.

SUMMARY OF THE INVENTION

The present invention relates to smoking articles incorporating tobacco in cut filler form and/or in a processed form. Preferred smoking articles have the form of a cigarette having two essential components: (i) a roll or charge of smokable filler material, and (ii) an outer wrapping material (e.g., a paper wrapper) circumscribing the roll of smokable filler material.

The preferred outer wrapping material, which surrounds the roll of smokable material to thereby form a smokable rod, is a low air permeability cigarette paper wrapper. Highly preferred wrappers having a low air permeability or low porosity exhibit a porosity less than about 15 CORESTA units. A CORESTA unit is a measure of the linear air velocity which passes through a 1 $cm^2$ area of wrapper at a constant pressure of 1 centibar. See CORESTA Publication ISO/TC 126/SC I N159E (1986). The wrapping material normally has a relatively high basis weight and is relatively opaque.

The outer wrap surrounds or circumscribes an insulating material, such as glass fibers or other resilient, heat resistant, air permeable ceramic material.

Within the insulating material is positioned a rod of smokable material, such as tobacco cut filler or any other material capable of producing aerosol (e.g., smoke) upon combustion. Normally the smokable cut filler is circumscribed by a wrapping material (e.g., a carbon/tobacco paper), particularly for ease of manufacture.

Preferred smoking articles of the present invention include a filter element which acts as a mouthpiece. Such smoking articles can be air diluted (e.g., by perforating the tipping material in the region which overlies the filter elements or by other such air dilution means). Normally, preferred smoking articles employ moderate to low efficiency filter elements, and the filter element is ventilated to provide a smoking article having an air dilution between about 25 and about 75 percent.

DETAILED DESCRIPTION OF THE PREFERRED EMBODIMENTS

Figure 1:
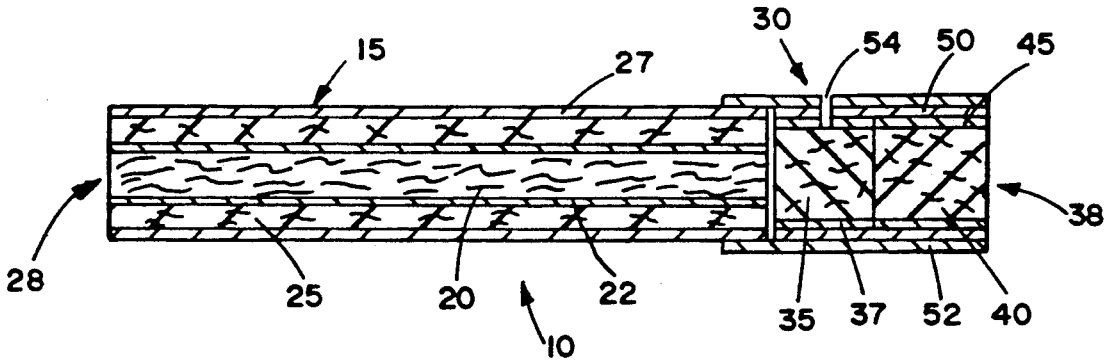
FIGS. 1 through 4 are longitudinal sectional views of smoking articles of the present invention.

A preferred embodiment of a cigarette of the present invention is shown in FIG. 1. The cigarette 10 includes a generally cylindrical rod 15. The rod includes a roll of smokable material 20 wrapped in a layer of circumscribing wrapping material 22 (e.g., paper) so as to form an "inner rod." The cigarette 10 includes an insulating material 25 circumscribing the wrapping material 22, and an outer wrapping material 27 circumscribing the insulating material. The inner rod is centrally located within the insulating material. The rod 15 is hereinafter referred to as a "smokable rod". The ends of the smokable rod 15 are open to expose the smokable material and insulating material, and to allow passage of air and smoke therethrough. The smokable rod is used by lighting one end thereof, and aerosol (e.g., smoke) is provided as a result of the combustion of the burning smokable material. As such, the smokable rod burns from the lit end 28 thereof towards the opposite end thereof.

The cigarette 10 also includes a filter element 30 positioned adjacent one end of the smokable rod 15 such that the filter element and smokable rod are axially aligned in an end-to-end relationship, preferably abutting one another. Filter element 30 has a generally cylindrical shape, and the diameter thereof is essentially equal to the diameter of the smokable rod. The ends of the filter element are open to permit the passage of air and smoke therethrough. The preferred filter element has at least two filter segments. As shown in FIG. 1, a first filter segment is positioned adjacent the smokable rod, and preferably includes a carbonaceous filter material 35 circumscribed by a wrapping material 37; while a second filter segment abuts the first filter segment and is positioned at extreme mouthend 38 of the cigarette, and preferably includes a filter material 40, such as a gathered non-woven cellulose acetate web, gathered non-woven polypropylene web or cellulose acetate tow, circumscribed by a wrapping material 45. The filter material 40 of the segment preferably is a material which provides an aesthetically pleasing, white appearance. Each of the filter segments is manufactured using known filter rod making machinery. The two segments are combined using known plug tube combining techniques, and are held together using circumscribing wrap 50 so as to form the filter element.

The filter element 30 normally is attached to the smokable rod 15 by tipping material 52, which circumscribes both the entire length of the filter element and an adjacent region of the smokable rod. The inner surface of the tipping material 52 is fixedly secured to the outer surface of the plug wrap 50 and the outer surface of the wrapping material 27 of the smokable rod, using a suitable adhesive. The cigarette 10 can be manufactured using known cigarette making techniques and equipment. Optionally, a ventilated or air diluted cigarette is provided with an air dilution means such as a series of perforations 54 which extend through the tipping material 52, plug wrap 50 and wrapping material 37. Such ventilation can be provided to the cigarette using known techniques, such as laser perforation techniques.

Figure 2:
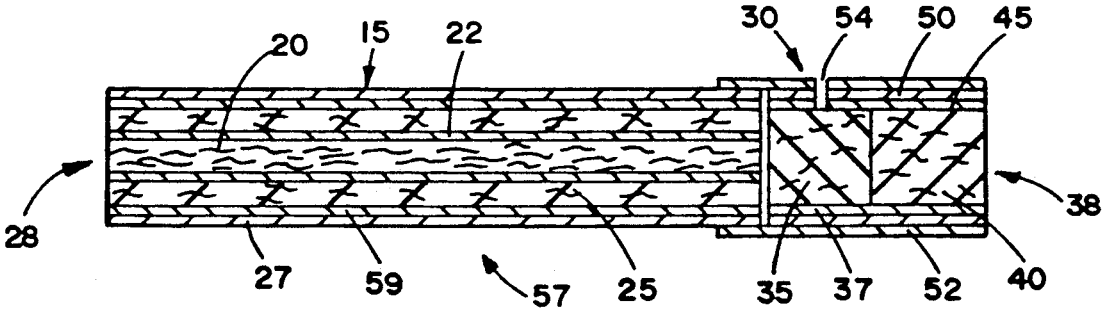

Referring to FIG. 2, cigarette 57 is similar to the cigarette 10 shown in FIG. 1, except that the smokable rod 15 includes at least one further wrapping material 59 circumscribing the insulating material 25. The further wrapping material 59 is in turn circumscribed by the outer wrapping material 27 such that the outer wrapping materials directly contact one another (i.e., the inner surface of outer wrapping material 27 contacts the outer surface of the further wrapping material 59).

Figure 3:
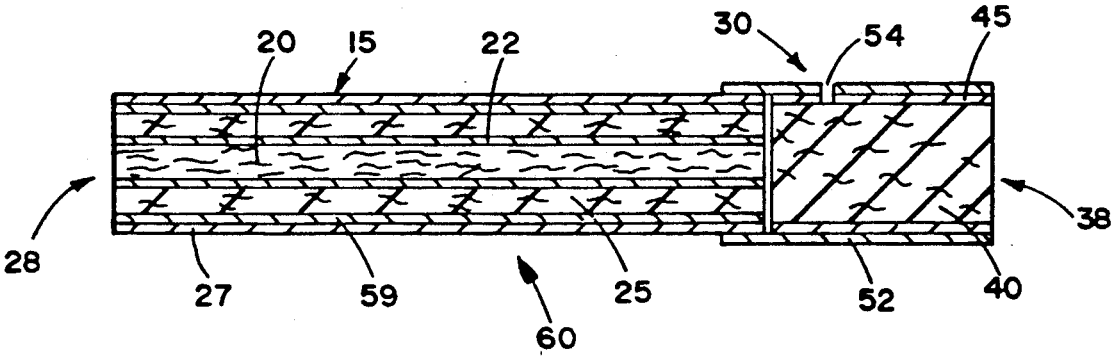

Referring to FIG. 3, cigarette 60 is similar to the cigarette 10 shown in FIG. 2, except that the filter element 30 of cigarette 60 comprises one segment of filter material 40 (e.g., cellulose acetate tow) circumscribed by wrapping material 45. The filter element 30 of the cigarette is axially aligned with the rod 15 in an abutting, end-to-end relationship.

Figure 4:
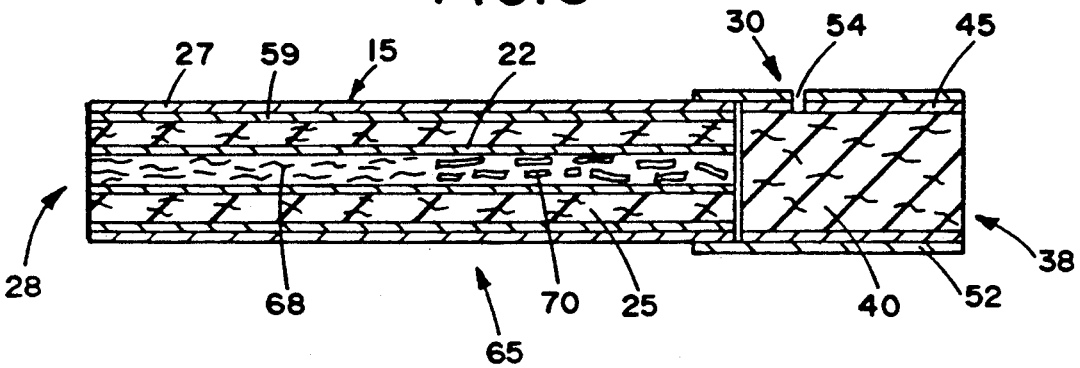

Referring to FIG. 4, cigarette 65 is similar to the cigarette 60 shown in FIG. 3, except that the smokable material has the form of a blend which is provided in a segmented fashion. At one end of the smokable rod 15 (i.e., at the end of the cigarette to be lit) is located a first segment 68 of smokable material. At the other end of the smokable rod 15 (i.e., at the end of the smokable rod adjacent the filter element) is located a second segment 70 of smokable material. Each segment is defined or identified in terms of its properties or composition (e.g., the packing densities of each segment is different and/or the composition of each segment is different). The segments are aligned in an abutting, end-to-end relationship; however, there can be a certain amount of intermixing of smokable materials in the region where the two segments meet. The length which each segment of smokable material extends along the smokable rod can vary. However, the relative longitudinal length of the first segment relative to the second segment normally ranges from about 1:9 to about 9:1, and frequently from about 1:4 to about 4:1.

Figure 5:
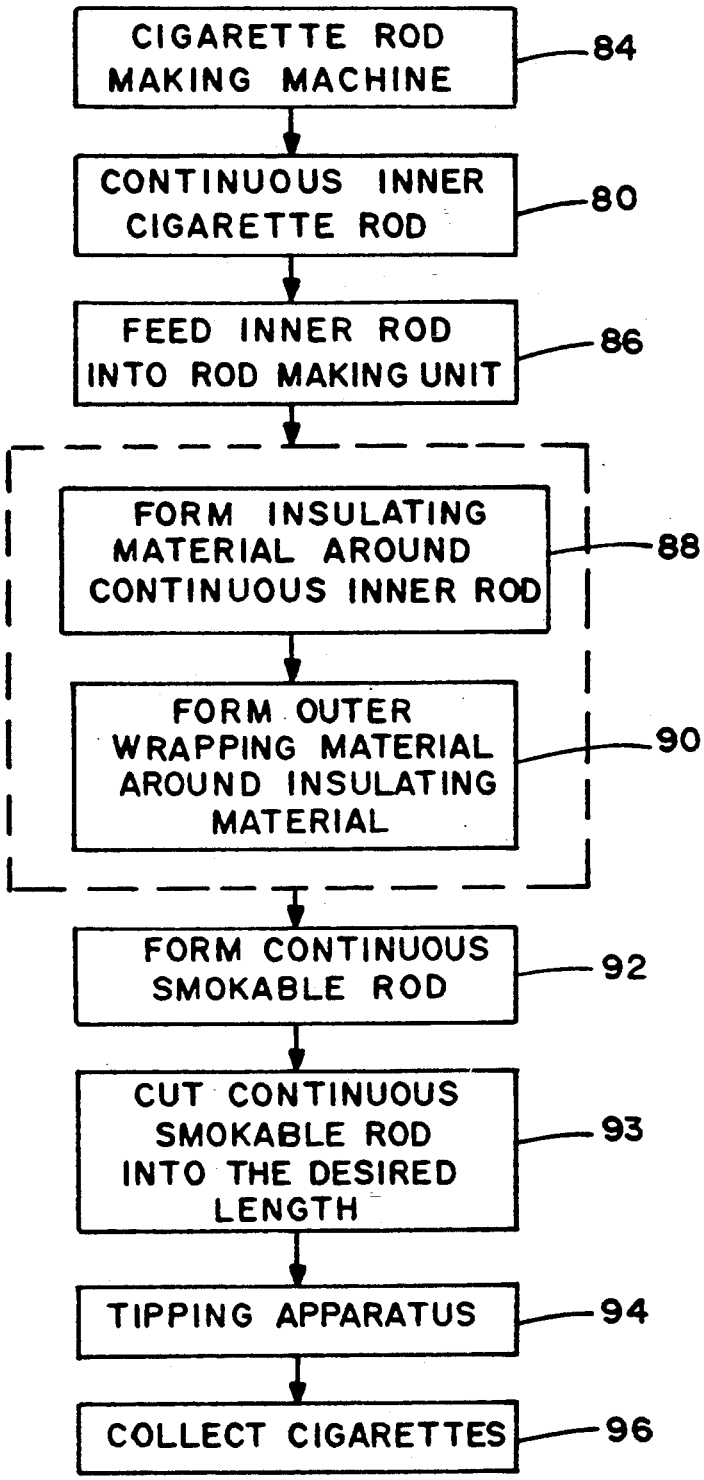
FIG. 5 is a schematic flow diagram of apparatus useful for manufacturing smoking articles of the present invention.

Referring to FIG. 5, there is shown a representative apparatus arrangement for preparing cigarettes of the present invention. A continuous inner rod 80 is manufactured using a conventional cigarette rod making machine 84, such as a Protos cigarette maker available from Hauni-Werke Korber & Co. K.G. The continuous inner rod includes smokable material circumscribed by a paper wrapping material. The continuous inner rod 80 then is fed directly into a rod making unit 86 of the type described in U.S. Pat. No. 4,893,637 to Hancock et al., which is incorporated herein by reference. As such, the insulating material 88 is formed around the continuous rod 84, and the outer wrapping material 90 is formed around the insulating material. As such, a continuous smokable rod 92 is formed. The rod 92 is cut 93 or otherwise subdivided into the desired length, and the filter elements are applied to the resulting rod segments using a tipping apparatus 94, such as a Max 80 tipper available from Hauni-Werke Korber & Co. K.G. Finished cigarettes 96 are then collected.

The smokable material employed in the manufacture of the smokable rod is a material capable of undergoing combustion to yield an aerosol (e.g., smoke). The smokable material can vary, and most preferably has the form of smokable filler material (e.g., cut filler). As used herein, the terms "smokable filler material" or "cut filler" in referring to smokable materials are meant to include smokable materials which have a form suitable for use in the manufacture of smokable rods for cigarettes. As such, smokable filler material can include a plurality of pieces of smokable materials which are blended and are in a form ready for cigarette manufacture. Smokable filler materials normally are employed in the form of strands or shreds as is common in cigarette manufacture. For example, cut filler can be employed in the form of strands or shreds from sheet-like or "strip" materials. Such strip materials are cut into widths ranging from about 1/5 inch to about 1/60 inch, preferably from about 1/25 inch to about 1/35 inch. Generally, the resulting strands or shreds have lengths which range from about 0.25 inch to about 3 inches.

The smokable materials can have the form of tobacco cut filler. The type of tobacco can vary, and can include flue-cured, Burley, Maryland and Oriental tobaccos, as well as the rare and specialty tobaccos, and blends thereof. Such tobacco cut filler can be provided in the form of tobacco laminae; volume expanded or puffed tobacco laminae; processed tobacco stems such as cut-rolled or cut-puffed stems; processed tobacco materials of the type described in U.S. patent application Ser. Nos. 392,519, filed Aug. 10, 1989 and 484,587, filed Feb. 23, 1990; reconstituted tobacco materials, such as (i) deproteinated tobacco materials described in U.S. Pat. Nos. 4,887,618 to Bernasek et al and 4,941,484 to Clapp et al, (ii) a phosphate-containing reconstituted tobacco material described in U.S. Pat. Nos. 3,353,541 and 3,420,241 to Hind et al, and 3,386,449 to Hind, as well as U.S. patent application Ser. Nos. 406,637, filed Sept. 13, 1989 and 461,216, filed Jan. 5, 1990, (iii) a reconstituted tobacco material described in U.S. patent application Ser. No. 272,156, filed Nov. 16, 1988 and *Tobacco Encyclopedia,* edit. by Voges, p. 389, TJI (1984), (iv) the reconstituted tobacco materials described in U.S. patent application Ser. Nos. 416,332, filed Sept. 29, 1989, 414,833, filed Sept. 29, 1989 and 569,325, filed Aug. 17, 1990, (v) the extruded reconstituted tobacco materials described in U.S. Pat. No. 4,880,018 to Graves, Jr., et al.; or blends thereof. The smokable material also can include densified processed particulates of tobacco materials, or processed mixtures of tobacco materials, carbon and/or alumina. Such densified processed particulates can be provided using a machine available as Marumerizer from Fuji Paudal KK.

Smokable filler materials can be cased and top dressed as is conventional during various stages of cigarette manufacture. For example, flavoring agents can be applied to the smokable filler material as is commonly performed when cigarette cut filler is processed. Suitable flavoring agents include vanillin, cocoa, licorice, menthol, and the like. Flavor modifying agents can be applied to the smokable filler material. A flavor modifying agent in the form of levulinic acid can be applied to the smokable filler material (e.g., in amounts ranging from about 0.01 to about 2 percent, normally from about 0.1 to about 1 percent, preferably about 0.2 to about 0.6 percent, based on the dry weight of the smokable filler material). Another flavor modifying agent in the form of potassium carbonate can be applied to the smokable filler material (e.g., in amounts of less than about 5 percent, normally about 2 to about 3 percent, based on the dry weight of the smokable filler material).

The smokable material is formed into the shape of a rod. Typically, the rod of smokable material has a circumference of about 5 mm to about 20 mm, preferably about 10 mm to about 15 mm. Most preferably, the smokable material employed has the form of a plurality of pieces (e.g., strands or shreds) of smokable material, which pieces are formed into a rod shape having a void volume so that air can readily pass therethrough, particularly during draw by the smoker.

The smokable material normally is circumscribed by a layer of wrapping material. The wrapping material can carbonate/magnesium hydroxide/flax paper, calcium carbonate/flax paper, tobacco/wood pulp paper, tobacco/carbon paper, and the like. The paper wrapping material can be treated with low levels of burn chemicals and/or fluxing agents, high levels of burn chemicals and/or fluxing agents, or can be coated with polymeric film forming agents (e.g., sodium carboxymethylcellulose). Examples of suitable wrapping materials include Reference Nos. 719, 856, 456 and 855 from Kimberly-Clark Corp.; papers available as P-2249-115, P-2831-23-3, P-2540-94-C, P-2540-94-D, P-144-BAC and SK-1 from Kimberly-Clark Corp.; and papers available as TOD 05504 and TOD 05505 from Ecusta Corp.

The packing density of the smokable filler material contained within the cigarette (e.g., contained within the inner wrapping material) can vary, but typically are less than about 400 mg/cm$^3$. Typical packing densities for smokable rods of cigarettes of the present invention range from about 150 to about 400 mg/cm$^3$. Normally, packing densities of such smokable rods range from about 170 to about 350 mg/cm$^3$, and frequently about 200 to about 300 mg/cm$^3$.

The insulating material circumscribes the smokable material; and forms a tube having an inner circumference approximately equal to the circumference of the inner rod of smokable material.

The outer circumference of the tube of insulating material is such that the radial thickness of the insulating material normally is greater than about 0.15 mm, usually greater than about 0.5 mm, and often greater than about 1 mm. Normally, the radial thickness of the tube of insulating material does not exceed about 3 mm, and usually does not exceed about 2 mm.

Insulating materials are materials that act primarily as insulators. Preferably, such materials do not burn when the cigarette is smoked; however, such materials may burn to some degree (e.g., in the case of slow burning carbon fibers) or fuse together to some degree (e.g., in the case of low temperature grade of glass fibers). Normally, the insulating materials have a fibrous form, and preferably are manufactured from ceramic materials. Highly preferred insulators have high void volumes (i.e., air space) and are composed of fibrous materials that tend to maintain the configuration materials include fibrous materials made out of glass, vitreous materials, alumina, calcium sulfate, calcium sodium metaphosphate, silica, silicons, carbon, boron, and the like, as well as mixtures thereof. Typical fibrous materials have average fiber diameters of about 2 microns to about 20 microns, and average lengths of about 1/16 inch to about 2 inches. Specific examples of insulating materials include Franklin Fiber A-30, A-45, H-30, H-45 and P-1 from U.S. Gypsum Corp.; C-glass and E-glass fibers available from Owens Corning Fiberglas; glass fibers designated as Manniglas 1000 and Manniglas 1200 from Manning Paper Co., and alumina/silica low density fibers available as Saffil from ICI Americas, Inc. Other examples of insulating materials are set forth in U.S. patent application Ser. Nos. 684,537, filed Dec. 21, 1984 and 354,605, filed May 22, 1989, which are incorporated herein by reference, as well as pages 48-52 of *Chemical and Biological Studies of New Cigarette Prototypes That Heat Instead of Burn Tobacco,* R. J. Reynolds Tobacco Co. publication (1988).

The insulating material circumscribes at least part of the length and at least part of the periphery of the inner rod of smokable material. It is highly preferred that the insulating material circumscribe the entire length and entire periphery of the inner rod of smokable material. The insulating material can have the form of one layer, or two or more layers extending outward from the periphery of the inner smokable rod. See, for example, the types of insulating wrapper configurations proposed in U.S. patent application Ser. No. 576,751, filed Aug. 29, 1990, which is incorporated herein by reference.

The insulating material is permeable to air flow and preferably remains permeable to air flow during the smoking period of the cigarette so as to permit environmental air to reach the periphery of the inner smokable rod, and hence support combustion of that inner rod during periods of smolder. The insulating material acts to retain heat produced by the burning inner smokable rod within the cigarette, and restrict heat loss through the outer periphery of the cigarette during smoking. The insulating material provides insulating properties sufficient so that the outer paper wrapping material does not change its general physical nature by thermally decomposing, charring, blackening or forming ash, but preferably undergoes some browning. Such browning of the outer wrapper typically occurs directly outward from the position of the fire cone of the inner smokable rod, particularly during draw, and hence the smoker is allowed to view the approximate remaining length of the unsmoked smokable rod during the smoking period.

Typical insulating materials have a thermal conductivity, in g-cal/(sec)(cmz)(.C/cm), of less than about 0.08, sometimes less than about 0.02, and occasionally less than about 0.005. See, Hackh's *Chemical Dictionary*, 34 (4th ed., 1969) and Lange's *Handbook of Chemistry*, 10, p 272–274 (11th ed., 1973). As such, maximum temperatures experienced by the outer wrapping material are such that the outer wrapping temperatures experienced by the outer wrapping material , do not exceed about 300° C., and usually do not exceed about 275° C., during the smoking period of the cigarette. However, the outer wrapping material can experience temperatures in excess of about 200° C. during the smoking period, particularly during periods of draw.

If desired, flavoring agents, tobacco particles and/or tobacco extracts can be located in the insulating material so as to enhance the flavor of the smoke provided by the smokable material.

The preferred outer wrapping material which provides the smokable rod is a cigarette wrapping material having a low air permeability value. Such a wrapping material normally has an air permeability of less than about 20 CORESTA units, usually less than about 15 CORESTA units, often less than about 10 CORESTA units, frequently less than about 5 CORESTA units, and occasionally less than about 1 CORESTA unit. Typical wrapping materials are cigarette paper wrappers, and particularly those paper wrappers having a burn retardant character. Typical paper wrappers can be treated with chemicals so as to increase the heat (e.g., temperature) at which thermal decomposition, charring, blackening or ashing of that paper wrapper occurs. Suitable wrapping materials are cigarette paper wrappers available as DD-71-1, DD-71-6, MTR-1021, P-2831-60-2, P-2831-60-3, P-878-158-1, P-2831-60-4, P-2831-60-5, P-2674-110, P-2831-60-1 and DD-100-2 from Kimberly-Clark Corp. Suitable low porosity cigarette paper wrappers are commercially available, and can have various levels of burn control chemicals, fluxing agents, burn retardants, etc., incorporated therein. For example, the cigarette paper wrapper can be treated with a mixture of ammonium bromide and diammonium hydrogen orthophosphate available as FIREVOID from Safety Plus Inc., monoammonium phosphate, magnesium glycerophosphate or potassium silicate. Also preferred are cigarette paper wrappers which include an amount of a polymeric film forming agent sufficient to provide a paper having the desirably low air permeability value. For example, a sufficient amount of a solution of a polymeric (e.g., carboxymethyl cellulose or ethylcellulose) film forming agent can be applied to the paper wrapper. The selection of the polymeric film forming agent will be apparent to the skilled artisan.

The optional polymeric film forming agent can be applied to the paper wrapper during the manufacture of the paper, or applied as a print or paint after manufacture of the paper is complete. Typically, the film forming agent is applied to the paper as a dilute solution (e.g., at a concentration of about 0.2 to about 5 weight percent relative to the solvent) for ease of processing. The amount of film forming agent applied to the paper wrapper depends upon factors such as the permeability of the paper and the film forming capabilities of the film forming agent. Typically, the amount of film forming agents employed ranges from about 1 to about 10 percent, based on the dry weight of the paper. For example, a 5 weight percent solution of ethylcellulose in ethanol or carboxymethylcellulose in water can be applied to cigarette paper using a size press, and the paper can be dried to provide a non-wetting, moisture resistant paper wrapper having a porosity of less than about 1 CORESTA unit, preferably less than about 0.5 CORESTA unit.

Typically, the smokable rod has a length which is greater than about 35 mm, preferably greater than about 40 mm; and which is less than about 85 mm, preferably less than about 65 mm. Typically, the smokable rod has a circumference of about 17 mm to about 27 mm, preferably about 22 mm to about 25 mm. Short smokable rods (i.e., having lengths from about 35 to about 50 mm) can be having a relatively high packing density are employed.

The cigarettes of the present invention preferably include a filter element, and often a filter element having more than one segment. For example, a preferred filter element has two or more filter segments. Typically, the segments of the preferred filter elements each have lengths which ranges from about 10 mm to about 35 mm; and circumferences of about 17 mm to about 27 mm, preferably about 22 mm to about 25 mm. The plug wrap which circumscribes the filter material of each filter segment typically is a conventional paper plug wrap, and can be either air permeable or essentially air impermeable.

Preferred filter materials of one of the filter segments include carbonaceous materials (e.g., activated carbon particles, charcoal particles, or carbon paper). An example of a particularly preferred filter material is provided by gathering a tobacco/carbon paper available as P-144-BAC from Kimberly-Clark Corp. Such filter materials reduce the levels of certain gas phase components from the mainstream smoke which passes to the mouth of the smoker. As such, preferred filter materials of that segment act to reduce the levels of any smoke components which may provide an off-taste or other undesirable characteristics to the mainstream smoke.

Preferred filter materials of another of the filter segments normally include fibrous materials. An example of a suitable filter material is a gathered nonwoven polypropylene web. A particularly preferred nonwoven polypropylene sheet-like web is available as PP-100-F from Kimberly-Clark Corp. Another preferred sheet-like web is available as CA Web from Celanese Corp. Another example of a suitable filter material is a cellulose acetate tow. Particularly preferred cellulose acetate tow items include (i) 8 denier per filament/40,000 total denier, and (ii) 8 denier per filament/15,000 total denier, (iii) 8 denier per filament/25,000 total denier, and (iv) 8 denier per filament/30,000 total denier. Plasticizers, such as triacetin, propylene glycol or triethyl citrate, can be combined with the filler materials.

Another filter segment can have a filter material in the form of a gathered web of nonwoven thermoplastic (i.e., hydrophobic) fibers in intimate contact with a water soluble tobacco extract so as to provide an extract-containing filter material. A highly preferred web is a nonwoven web of polypropylene fibers available as PP 200 SD from Kimberly-Clark Corp. Exemplary filter segments and filter elements are described in U.S. patent application Ser. Nos. 414,835, filed Sept. 29, 1989 and 518,597, filed May 3, 1990. The filter segments also can include those tobacco extracts described in U.S. patent application Ser. Nos. 452,175 filed Dec. 18, 1989, and 536,250 filed June 11, 1990. Such segments can provide enhanced flavor characteristics to the mainstream smoke which passes therethrough.

Yet another filter segment can include a tobacco paper material as the filter material. For example, a filter material can have the form of a gathered web of tobacco paper available as P-144-B from Kimberly-Clark Corp.

The filter element segments suitable for use in this invention can be manufactured using known cigarette filter making techniques. Filter elements can be manufactured from cellulose acetate tow using known techniques. Filter elements can be manufactured from carbon paper, tobacco paper and a sheet-like nonwoven polypropylene web using filter making techniques described in U.S. Pat. No. 4,807,809 to Pryor et al, which is incorporated herein by reference. Alternatively, particles of charcoal, densified tobacco or activated carbon can be incorporated into the filter element using a so-called "triple filter" configuration by positioning the particles between two segments of suitable filter materials.

The filtration efficiency of the filter element can vary, and the filtration efficiency can be high, moderate or low. Preferred filter elements have minimal mainstream aerosol (i.e., smoke) removal efficiencies while maintaining the desirable draw characteristics of the cigarette. Such minimal smoke removal efficiencies are provided by "low efficiency" filter elements. Low efficiency filter elements have a minimal ability to remove mainstream smoke particulates. See, Keith in Schemeltz's The Chemistry of Tobacco and Tobacco Smoke, p. 157 (1972). Generally, low efficiency filter elements provide less than about 40 weight percent mainstream smoke particulate removal efficiency.

Tipping material circumscribes the filter element and an adjacent region of the smokable rod such that the tipping material extends about 3 mm to about 6 mm along the length of the smokable rod. Typically, the tipping material is a conventional paper tipping material. Tipping materials of varying porosities can be employed. For example, the tipping material can be essentially air impermeable, air permeable, or treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

For air diluted or ventilated cigarettes of the present invention, the amount of air dilution can vary. Typically, the amount of air dilution for an air-diluted cigarette is greater than about 25 percent, and frequently greater than about 40 percent. The upper limit for air dilution for a cigarette typically is less than about 75 percent, more frequently less than about 65 percent. As used herein, the term "air dilution" is the ratio (expressed as a percentage) of the volume of air drawn through the air dilution means to the total volume of air and aerosol (i.e., smoke) drawn through the cigarette and exiting the extreme mouthend portion of the cigarette. See, Selke et al, Beitr. Zur Tabak. In., Vol. 4, p. 193 (1978).

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180 mm, more preferably about 80 to about 150 mm water pressure drop at 17.5 cc/sec. air flow. The resistance to draw is provided principally by the rod of smokable material.

Cigarettes of the present invention, when smoked, provide a flavorful mainstream aerosol. The cigarettes burn at an acceptable rate, and maintain static smolder, at least when smoked under FTC smoking conditions. The ash resulting from the combusted smokable material tends to remain in the cigarette during the smoking period, and does not tend to fall out of the cigarette. During puffing, brown marks form on the outer wrapper (i.e., as rings encircling the smokable rod) to show the approximate location of the fire cone.

Cigarettes of the present invention, when smoked, generally yield less than about 5 mg, preferably less than about 2 mg of sidestream "tar" per cigarette, as by Proctor et al, Analyst, Vol. 113, p. 1509 (1988). Such cigarettes normally provide more than about 5 puffs, preferably more than about 6 puffs per cigarette, when smoked under FTC conditions. Normally, cigarettes of the present invention provide less than about 15 puffs, and often less than about 10 puffs, when smoked under FTC conditions.

The following examples are provided in order to further illustrate the invention but should not be construed as limiting the scope thereof. Unless otherwise noted, all parts and percentages are by weight.

EXAMPLE 1

Cigarettes substantially as shown in FIG. 3 are provided as follows:

The cigarettes each have a length of about 90 mm and a circumference of about 25 mm, and include a smokable rod having a length of about 69 mm, and a filter element having a length of about 21 mm. Both ends of the smokable rod and both ends of the filter element are open to permit the passage of air and smoke therethrough. The filter element is attached to the smokable rod using an essentially nonporous tipping paper. For each cigarette, the tipping paper circumscribes the filter element and about a 9 mm length of the smokable rod in the region adjacent the filter element. The cigarettes are not air diluted.

The inner rod includes the smokable material in cut filler form including about 38 percent flue-cured tobacco, about 16 percent Burley tobacco, about 18 percent Oriental tobaccos, about 23 percent reconstituted tobacco sheet and about 5 percent volume expanded flue-cured tobacco. The smokable material is cased and top dressed with glycerin and flavors. The wrapper of the inner rod is a tobacco-based paper sheet available as SK-1 from Kimberly-Clark Corp. The rod has a circumference of about 12.5 mm.

The filter element is provided using known techniques using cellulose acetate tow (3.3 denier per filament; 44,000 total denier). The tow is plasticized at about an 8 percent level using triacetin plasticizer. The plug wrap for the filter element is available as Reference No. 626 from Ecusta Corp. The filter element is positioned adjacent the smokable rod in an abutting end-to-end relationship with the smokable rod.

The cigarette outer paper wrapper includes calcium carbonate and attapulgite clay inorganic filler, exhibits a basis weight of about 45 g/m$^2$, and exhibits an air permeability of about 13 CORESTA units. The cigarette paper is available as P-878-158-1 from Kimberly-Clark Corp.

The insulating material is an air permeable borosilicate glass fiber insulator available as C-glass from Owens Corning Fiberglass. The glass fibers are chopped strands of glass having average diameters of about 8 microns and average lengths of about ⅜ inch. The insulating material within the cigarette weighs about 0.45 g.

Cigarettes are provided by wrapping the insulating material completely around a polypropylene tube, and circumscribing the insulating material with a paper wrapper available as P-780-63-5 from Kimberly-Clark Corp. The wrapper is circumscribed by the outer paper wrapper. A polyvinylacetate adhesive is used along the lap zone of the outer wrapper in order to maintain that wrapper in place. The polypropylene tube is removed from the resulting wrapped insulating material, and the inner rod is inserted in place of the polypropylene tube. The inner rod is held in place in the insulating material by friction fit. The entire length of the inner rod is circumscribed by the insulating material. As such, the insulating material is positioned between the inner rod and the outer wrapper.

The cigarettes are employed by lighting one end thereof with a cigarette lighter, and burning the smokable rod such that the smokable material within the paper wrapper burns to yield tobacco smoke. Less than about 5 mm of the length of the outer wrapper forms ash at the extreme lighting end of the cigarette due to the lighter flame. When employed, such cigarettes yield very low levels of visible sidestream smoke and essentially no sidestream odor. Cigarettes smoked under FTC smoking conditions each yield about 10 puffs and about 19.6 mg wet total particulate material, of which about 0.7 mg is nicotine and about 2.7 mg is water. The cigarettes do not self-extinguish during the smolder period experienced during FTC smoking conditions. The ash resulting from the burning of the inner rod is held within the smokable rod by the insulating material. The outer wrapper undergoes a slight browning during the smoking period, but does not char or form an ash. When viewed end-on after the smoking period, the extreme mouth end of the filter element exhibits slight discoloration which is uniformly distributed over the face of the filter element.

EXAMPLE 2

Cigarettes are prepared as described in Example 1, except that the cigarettes are air diluted about 10 percent by providing a circumscribing ring of perforations through the tipping material and plug wrap, about 13 mm from the extreme mouthend of the cigarette.

The cigarettes are smoked and yield very low levels of visible sidestream smoke. The cigarettes are smoked under FTC smoking conditions using the apparatus and technique for measuring sidestream "tar" which is set forth in U.S. Pat. No. 4,942,888 to Montoya et al. Cigarettes smoked and tested in this manner yield about 1.7 mg sidestream "tar" and about 0.07 mg sidestream nicotine, per cigarette.

EXAMPLE 3

Cigarettes substantially as shown in FIG. 4 are provided as described in Example 1; except that about 150 mg of the smokable material described in Example 1 extends about 59 mm along the length of the inner rod, and about 50 mg of densified tobacco particles extends about 10 mm along the length of the inner rod adjacent the filter element.

The densified tobacco particles have an average size of between about 12 and about 20 U.S. Mesh, and are manufactured from a mixture of about 42.5 parts flue-cured tobacco cut filler, about 42.5 parts of a reconstituted cut filler tobacco provided using a paper-making process, and about 15 parts glycerin. The densified tobacco particles are manufactured by kneading the mixture using a Model K DHJ20 Batch Kneader, and then extruding the mixture using an Extruder Model EXDCS 100, and then processing the mixture using a Model QJ 400 Marumerizer, and then drying the mixture using a Model MDB 400 Midget Dryer. The kneader, extruder, marumerizer and dryer are all available from Fuji Paudal KK.

EXAMPLE 4

Cigarettes are manufactured as described in Example 1, except that the smokable material is 150 mg of a reconstituted tobacco material which is provided using a paper-making process. The reconstituted tobacco material includes about 10 parts tobacco laminae powder, about 30 parts calcium carbonate particles available as Reference 15M from Georgia Marble Co., and about 60 parts of a reconstituted tobacco material which had previously been reconstituted using a paper-making process.

EXAMPLE 5

Cigarettes are manufactured as described in Example 1, except that the smokable material is a blend of about 30 mg of a carbon filler and about 120 mg of a tobacco cut filler blend. Both of the carbon filler and the tobacco cut filler have the form of shreds cut at about 32 cuts per inch. The tobacco cut filler blend includes about 16 parts Burley tobacco, about 35 parts flue-cured tobacco, about 15 parts Oriental tobaccos, about 7 parts volume-expanded flue-cured tobacco and about 22 parts of a reconstituted tobacco material manufactured using a paper-making process. The tobacco cut filler blend is cased with licorice, cocoa, and propylene glycol, is top dressed with flavors, and exhibits a moisture content of about 12.5 percent. The carbon filler is provided by casting an aqueous slurry of about 75 parts water, and about 25 parts of a solids portion which consists of about 11 percent high fructose corn syrup, about 5 percent parts propylene glycol, about 8 percent methylhydroxypropyl cellulose available as Culminal MHPC-P20,000 from Aqualon Co., and about 74 percent hardwood carbon which is prepared by heating hardwood having a cellulosic content of about 80 to about 90 percent under nitrogen atmosphere at about 800° C. to about 900° C. The cast slurry then is dried to provide having a thickness of about 15 mils to about 20 mils.

EXAMPLE 6

Cigarettes are manufactured as described in Example 5, except that the wrapper of the inner rod is a tobacco/carbon paper available as P-2540-101-2 from Kimberly-Clark Corp. The paper includes about 23 percent carbon, which is available as PCB-60 carbon from Calgon Corp.

The cigarettes smoked under FTC smoking conditions each yield about 11 puffs, and about 19 mg wet total particulate manner, of which about 0.5 mg is nicotine and about 3.4 mg is water.

EXAMPLE 7

Cigarettes are manufactured as described in Example 1, except that a fire retardant available as FIREVOID from Safety Plus, Inc. is applied to outer paper wrapper. The fire retardant material is sprayed onto the entire outer surface of the outer wrapping material of the smokable rod so as to slightly wet the outer wrapping material. The outer wrapping material is allowed to dry.

What is claimed is:

1. A cigarette comprising:

(a) a rod of smokable material having a packing density of less than about 400 mg/cm$^3$;

(b) insulating material circumscribing the rod of smokable material, the insulating material (i) being permeable to airflow during the period that the cigarette is smoked, and (ii) exhibiting a radial thickness of greater than about 0.5 mm; and (c) outer wrapping material having an air permeability of less than about 15 CORESTA units circumscribing the insulating material.

2. The cigarette of claim 1 wherein the rod of smokable material includes smokable material circumscribed by a wrapping material.

3. A cigarette comprising:

(a) a rod of smokable material having a packing density of less than about 400 mg/cm$^3$;

(b) insulating material including glass fibers circumscribing the rod of smokable material; and (c) outer wrapping material having an air permeability of less than about 15 CORESTA units circumscribing the insulating material.

4. The cigarette of claim 1 wherein essentially all of the smokable material has the form of tobacco cut filler.

5. The cigarette of claim 1, 2, 3 or 4 wherein the smokable material of the smokable rod has a packing density of about 200 mg/cm$^{33}$ to about 300 mg/cm$^3$.

6. The cigarette of claim 1, 2, 3 or 4 wherein the outer wrapping material has an air permeability of less than about 10 CORESTA units.

7. The cigarette of claim 1, 2, 3 or 4 wherein the rod of smokable material has a length of greater than about 35 mm.

8. The cigarette of claim 1, 2, 3 or 4 wherein the rod of smokable material has a circumference of about 5 mm to about 20 mm, and the insulating material has a radial thickness of greater than about 0.25 mm.

9. The cigarette of claim 1, 2, 3 or 4 wherein the rod of smokable material has a circumference of about 10 mm to about 15 mm, and the insulating material has a radial thickness of greater than about 0.5 mm.

10. The cigarette of claim 3 wherein the rod of smokable material includes smokable material circumscribed by a wrapping material.

11. A cigarette comprising:

(a) a rod of smokable material having a packing density of less than about 400 mg/cm$^3$;

(b) insulating material circumscribing the rod of smokable material, the insulating material (i) being permeable to airflow during the period that the cigarette is smoked;

(c) outer wrapping material circumscribing the insulating material and experiencing a temperature not exceeding about 300° C. during the period that the cigarette is smoked after lighting; and (d) a mouthend piece.

12. The cigarette of claim 11 wherein the rod of smokable material includes smokable material circumscribed by a wrapping material.

13. A cigarette comprising:

(a) a rod of smokable material having a packing density of less than about 400 mg/cm$^3$;

(b) insulating material including glass fibers circumscribing the rod of smokable material;

(c) outer wrapping material circumscribing the insulating material; and (d) a mouthend piece.

14. The cigarette of claim 11 wherein essentially all of the smokable material has the form of tobacco cut filler.

15. The cigarette of claim 11, 12, 13 or 14 wherein the smokable material of the smokable rod has a packing density of about 200 mg/cm$^3$ to about 300 mg/cm$^3$.

16. The cigarette of claim 11, 12, 13 or 14 wherein the outer wrapping material has an air permeability of less than about 10 CORESTA units.

17. The cigarette of claim 11, 12, 13, or 14 wherein the rod of smokable material has a length of greater than about 35 mm.

18. The cigarette of claim 11, 12, 13 or 14 wherein the rod of smokable material has a circumference of about 5 mm to about 20 mm, and the insulating material has a radial thickness of greater than about 0.25 mm.

19. The cigarette of claim 11, 12, 13, or 14 wherein the rod of smokable material has a circumference of about 10 mm to about 15 mm, and the insulating material has a radial thickness of greater than about 0.5 mm.

20. The cigarette of claim 11, 12, 13, or 14 wherein the mouthend piece is a filter element.

21. A cigarette comprising:

(a) a rod of smokable material having the form of a plurality of pieces of cut filler;

(b) insulating material circumscribing the rod of smokable material, the insulating material (i) being permeable to airflow during the period that the cigarette is smoked, and (ii) exhibiting a radial thickness of greater than about 0.5 mm;

(c) outer wrapping material circumscribing the insulating material; and (d) a mouthend piece.

22. The cigarette of claim 20 wherein the plurality of pieces of cut filler is circumscribed by a wrapping material.

23. A cigarette comprising:

(a) a rod of smokable material having the form of a plurality of pieces of cut filler;

(b) insulating material including glass fibers circumscribing the rod of smokable material;

(c) outer wrapping material circumscribing the insulating material; and (d) a mouthend piece.

24. The cigarette of claim 21 wherein essentially all of the smokable material has the form of tobacco cut filler.

25. The cigarette of claim 21 wherein the outer wrapping material has an air permeability of less than about 10 CORESTA units.

26. The cigarette of claim 24 or 25 wherein the rod of smokable material has a length of greater than about 35 mm.

27. The cigarette of claim 21 or 25 wherein the mouthend piece is a filter element.

28. A cigarette comprising:

(a) a rod of smokable material having a packing density of less than about 400 mg/cm$^3$, and a circumference of about 5 to about 20 mm;

(b) insulating material circumscribing the rod of smokable material and having a radial thickness of greater than about 0.25 mm; and (c) outer wrapping material having an air permeability of less than about 15 CORESTA units circumscribing the insulating material.

29. A cigarette comprising:

(a) a rod of smokable material having a packing density of less than about 400 mg/cm$^3$, and a circumference of about 10 to about 15 mm;

(b) insulating material circumscribing the rod of smokable material and having a radial thickness of greater than about 0.5 mm; and (c) outer wrapping material circumscribing the insulating material and (d) a mouthend piece.

30. A cigarette comprising:

(a) a rod of smokable material having a packing density of less than about 400 mg/cm$^3$, and a circumference of about 5 to about 20 mm;

(b) insulating material circumscribing the rod of smokable material and having a radial thickness of greater than about 0.25 mm; and (c) outer wrapping material circumscribing the insulating material; and (d) a mouthend piece.

31. A cigarette comprising:

(a) a rod of smokable material having a packing density of less than about 400 mg/cm$^3$, and a circumference of about 10 to about 15 mm;

(b) insulating material circumscribing the rod of smokable material and having a radial thickness of greater than about 0.5 mm; and (c) outer wrapping material circumscribing the insulating material; and (d) a mouthend piece.

32. A cigarette comprising:

(a) a rod of smokable material having a packing density of less than about 400 mg/cm$^3$;

(b) fibrous insulating material circumscribing the entire length and periphery of the rod of smokable material.

(c) outer wrapping material circumscribing the insulating material and not undergoing a change in its general physical nature during the period that the cigarette is smoked after lighting; and (d) a mouthend piece.

33. The cigarette of claim 32 wherein the rod of smokable material includes smokable material circumscribed by a wrapping material.

34. The cigarette of claim 32 wherein the insulating material includes glass fibers.

35. The cigarette of claim 32 wherein essentially all of the smokable material has the form of tobacco cut filler.

36. The cigarette of claim 1, 11, 21, 28, 30 or 32 wherein each end of the smokable rod is open to expose the smokable material and insulating material, and allow passage of air and smoke therethrough.

37. The cigarette of claim 1, 11, 21, 28, 30 or 32 including a filter element as a mouthend piece; wherein the filter element and smokable rod are axially aligned in an abutting end-to-end relationship, and each end of the filter element is open to permit passage of air and smoke therethrough.

38. The cigarette of claim 36 including a filter element as a mouthend piece; wherein the filter element and smokable rod are axially aligned in an abutting end-to-end relationship, and each end of the filter element is open to permit passage of air and smoke therethrough.

39. The cigarette of claim 1, 11, 21, 28, 30 or 32 wherein the rod of smokable material is centrally located within the insulating material.

40. The cigarette of claim 1, 11, 21, 28, 30 or 32 including at least one further wrapping material circumscribing the insulating material, which is in turn circumscribed by the outer wrapping material.

41. The cigarette of claim 1, 11, 21, 28, 30 or 32 wherein the insulating material exhibits a radial thickness not exceeding about 3 mm.

* * * * *

UNITED STATES PATENT AND TRADEMARK OFFICE

CERTIFICATE OF CORRECTION

PATENT NO. : 5,105,838

DATED : April 21, 1992

INVENTOR(S) : Jackie L. White et al.

It is certified that error appears in the above—identified patent and that said Letters Patent is hereby corrected as shown below:

Col. 6, line 1, after "can" insert --vary, and can be tobacco/calcium carbonate paper, calcium--.

Col. 6, line 44, after "configuration" insert --of the insulator over time. Examples of insulating--.

Col. 7, line 28, "(.C/cm)" should be --(°C/cm)--.

Col. 7, line 34, after "wrapping" insert --material normally does not undergo combustion. Typical--.

Col. 8, line 39, after "be" insert --employed, particularly when smokable filler materials--.

In the claims:

Col. 14, line 19, delete "(i)".

Col. 15, line 18, "claim 24" should be --claim 21--.

Col. 15, line 41, after "material" insert --having an air permeability of less than about 15 Coresta units circumscribing the insulating material.--.

Col. 15, line 41 and 42, delete "circumscribing the insulating material and"

UNITED STATES PATENT AND TRADEMARK OFFICE

CERTIFICATE OF CORRECTION

PATENT NO. : 5,105,838

DATED : April 21, 1992

INVENTOR(S) : Jackie L. White et al

It is certified that error appears in the above-identified patent and that said Letters Patent is hereby corrected as shown below:

Column 15, line 43, delete "(d) a mouthend piece.".

Signed and Sealed this

Eighteenth Day of January, 1994

*Attest:*

*Attesting Officer*

BRUCE LEHMAN

*Commissioner of Patents and Trademarks*